US007205725B1

(12) United States Patent
Lai

(10) Patent No.: US 7,205,725 B1
(45) Date of Patent: Apr. 17, 2007

(54) ELECTRONIC STABILIZER USED FOR HAND-HELD LAMP

(76) Inventor: Li-Chun Lai, 21F-1, No.33, Sec.1, Minsheng Rd, Panciao City, Taipei County (TW)

( * ) Notice: Subject to any disclaimer, the term of this patent is extended or adjusted under 35 U.S.C. 154(b) by 36 days.

(21) Appl. No.: 11/259,024

(22) Filed: Oct. 25, 2005

(51) Int. Cl.
*H05B 37/02* (2006.01)

(52) U.S. Cl. ..... 315/219; 315/209 R; 315/DIG. 7

(58) Field of Classification Search ..... 315/209 R, 315/219, 224, 244, 248, 291, 307, DIG. 7
See application file for complete search history.

(56) References Cited

U.S. PATENT DOCUMENTS 4,871,971 A * 10/1989 Jeerings et al. ..... 324/509
5,798,615 A * 8/1998 Gasparini et al. ..... 315/219
5,994,843 A * 11/1999 Kataoka et al. ..... 315/106

* cited by examiner

*Primary Examiner*—Tuyet Vo
*Assistant Examiner*—Jimmy Vu

(57) ABSTRACT

An electronic stabilizer used for hand-held lamp is disclosed. The electronic stabilizer of the present invention comprises four circuits: a current overflow protection and current source noise absorption circuit, a voltage-enhancing rectification filtering circuit, a high-frequency oscillation circuit and a harmonic oscillation output circuit. The current overflow protection and current source noise absorption circuit can protect against current overflow and current source noises. The voltage-enhancing rectification filtering circuit may covert the AC to DC after rectifying and filtering out the current. Next, the DC is fed to the high-frequency oscillation circuit, which may convert the DC to rectangular wave signals. Then, the harmonic oscillation output circuit converts these rectangular wave signals into sine wave (near sine wave) signals. Now, the sine wave signals may light up one or more fluorescent lights and may enable these fluorescent lights to give out continuous light without any flickers.

8 Claims, 1 Drawing Sheet

ELECTRONIC STABILIZER USED FOR HAND-HELD LAMP

BACKGROUND OF THE INVENTION

1. Field of the Invention

The invention generally relates to an electronic stabilizer used for a hand-held lamp. More particularly, the invention relates to an electronic stabilizer (to be used for a hand-held lamp) with low energy consumption rate, high efficiency and low noise level.

2. Description of the Prior Art

Because fluorescent light is bright enough and has a longer service life, it has become the main type of light. A stabilizer is needed in a fluorescent light assembly so that sufficiently high voltage is provided to light up a fluorescent light bulb and enables the fluorescent light bulb to give out stable light.

The prior art stabilizer is of electromagnetic coupling type and comprises one or more inductors and a starting element. Though such stabilizer can light up a fluorescent light bulb, such stabilizer causes the fluorescent light bulb to give out flickering light due to the frequency (for example, 60 Hz) of the AC source. Also, such stabilizer has other disadvantages such as low efficiency and relatively heavy weight; furthermore, if the inductors are not well made, they may generate undesirable noises.

Therefore, there remains a need for a stabilizer that is relatively efficient, relatively light weight, and generate less noises.

To eliminate the disadvantages of the prior art stabilizer, the inventor has performed substantial research in the subject and has successfully came up with the electronic stabilizer of the present invention.

SUMMARY OF THE INVENTION

A first object of the present invention is to provide an electronic stabilizer (used for hand-held lamp) that is efficient and compact and generates no noises, or relatively less noises then those in the prior art.

Another object of the present invention is to provide an electronic stabilizer (used for hand-held lamp) that enables a fluorescent light to give out relative stable light having relatively less flickers.

The electronic stabilizer (used for hand-held lamp) of the present invention comprises four circuits: a current overflow protection and current source noise absorption circuit, a voltage-enhancing rectification filtering circuit, a high-frequency oscillation circuit and a harmonic oscillation output circuit. The current overflow protection and current source noise absorption circuit can protect against current overflows and current source noises. The voltage-enhancing rectification filtering circuit may covert the AC (alternating current) to DC (direct current) after rectifying and filtering out the current. Next, the DC is fed to the high-frequency oscillation circuit, which may convert the DC to rectangular wave signals. Then, the harmonic oscillation output circuit converts these rectangular wave signals into sine wave (or near sine wave) signals. Subsequently, the sine wave signals can light up one or more fluorescent light bulbs and may enable these fluorescent light bulbs to give out continuous light without any (detectable) flickers.

These features and advantages of the present invention will be fully understood and appreciated from the following detailed description of the accompanying Drawings.

DETAILED DESCRIPTION OF THE PREFERRED EMBODIMENT

Figure 1:
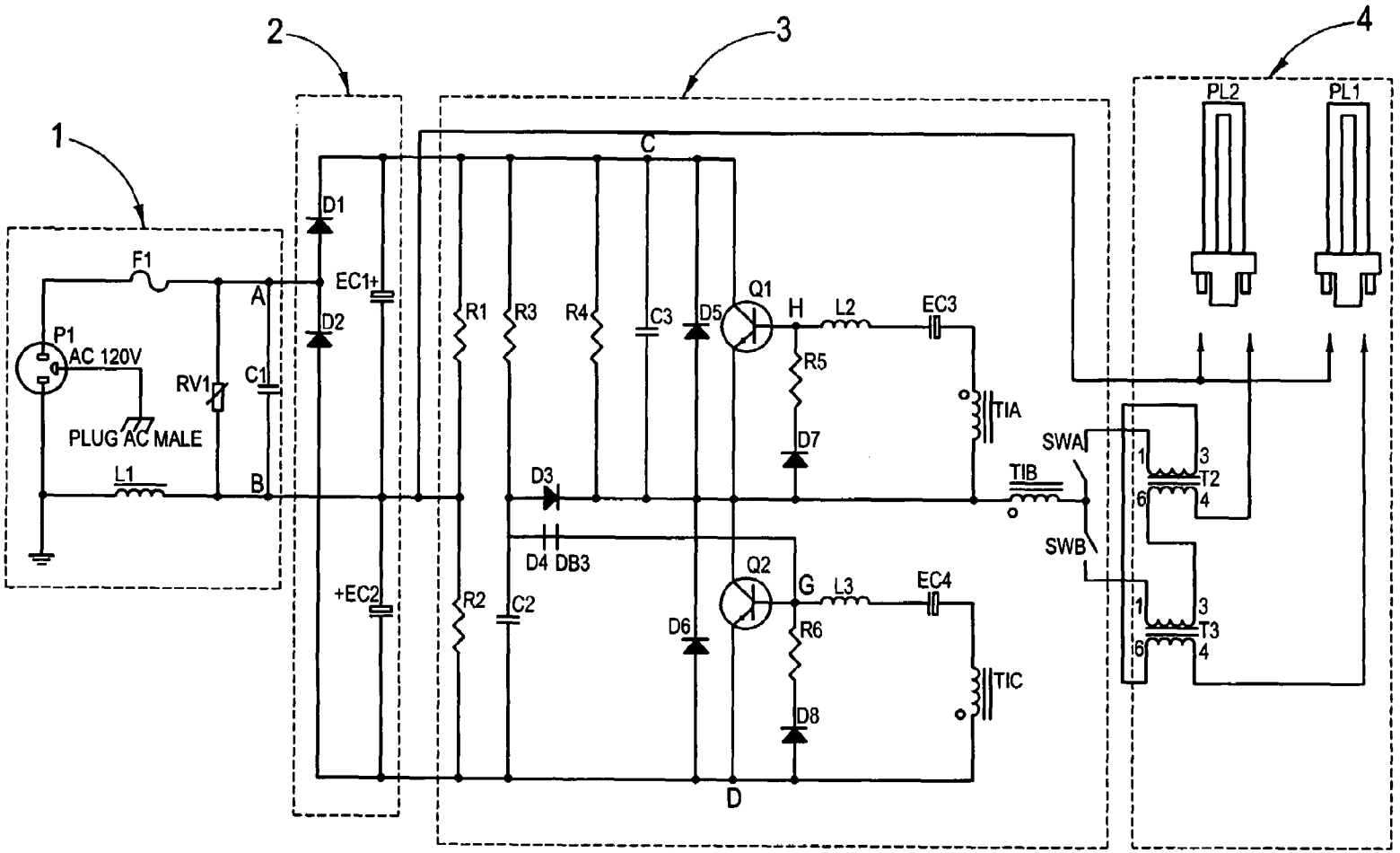
FIG. 1 is a diagram schematically illustrating the four circuits of the electronic stabilizer (used for hand-held lamp) of the present invention.

Referring to FIG. 1, an electronic stabilizer (used for hand-held lamp) according to the present invention is shown and comprises four circuits: a current overflow protection and power source noise absorption circuit 1, a voltage-enhancing rectification filtering circuit 2, a high-frequency oscillation circuit 3 and a harmonic oscillation output circuit 4.

The current overflow protection and current source noise absorption circuit 1 can receive AC from a power source and protect against current overflow and current source noises so as to stabilize the current. The circuit 1 comprises a glass tube fuse F1, an inductor L1, a variable resistor RV1 and a capacitor C1. The fuse F1 is used for the protection against current overflow: if there was a current overflow, the fuse will burn out. The inductor L1 may eliminate the high frequency noises in the current source and in the circuit. The variable resistor RV1 and the capacitor C1 may eliminate surges in voltage and in noise. Hence, with the circuit 1, the protection against current overflows may be achieved and current source noises may be eliminated or minimized.

The voltage-enhancing rectification filtering circuit 2 may receive AC from the circuit 1 and covert AC to DC. The circuit 2 comprises two diodes D1 and D2, and two capacitors EC1 and EC2, so as to rectify and filter the current received from the circuit 1 such that the voltage drop across the positive terminal of the conductor EC1 and the negative terminal of the conductor EC2 is about 280 V (of DC).

The high-frequency oscillation circuit 3 may receive DC from the circuit 2 and convert the DC to high-frequency (about 38,000 Hz) rectangular wave signals. The circuit 3 comprises a plurality of resistors R1, R2, R3, R4, R5 and R6, a plurality of capacitors C2, C3, EC3 and EC4, a plurality of diodes D3, D4, D5, D6, D7, D8, two induction coils L3 and L4, two transistors Q1 and Q2 and a pulse transformer T1. In use, the resistor R2 may charge up the capacitor C2; when the voltage drop across the capacitor C2 exceeds the triggering voltage (about 32V) of the two-way diode D4 (DB3), the diode D4 and the transistor Q2 become passable. Now, with the positive feedback effect of the pulse transformer T1, the two transistors Q1 and Q2 can convert DC to rectangular wave signals.

The harmonic oscillation output circuit 4 may receive the rectangular wave signals from circuit 3 and covert the rectangular wave signals into sine wave (or near sine wave) signals so as to ensure that a fluorescent light bulb gives out stable light. The circuit 4 comprises two transformers T1 and T2. The high voltage generated by the two transformers T1 and T2 may light up the two fluorescent light bulbs PL1 and PL2. After the two fluorescent light bulbs PL1 and PL2 are lit, the circuit 4 may limit the current flow so that the two lights may give out stable light. Also, two switches SWA and SWB are provided between the circuit 3 and the circuit 4 so as to turn on and off the two light bulbs PL1 and PL2. Alternatively, there may be three or more switches so as to turn on and off a plurality of lights.

The electronic stabilizer (used for hand-held lamp) of the present invention has the following three advantages when compared to stabilizer in the prior art:

1. A current overflow protection and power source noise absorption circuit is disposed in front of, or upstream of, a voltage-enhancing rectification filtering circuit so that the protection against current overflows may be achieved and current source noises may be eliminated or minimized.
2. The electronic stabilizer of the present invention has low energy consumption rate, relatively high efficiency, relative compact size and low noise level.
3. The electronic stabilizer of the present invention may enable a fluorescent light bulb to give out continuous light without any (detectable) flickers, or minimize flickers.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. An electronic stabilizer used for hand-held lamp, comprising:

a current overflow protection and current source noise absorption circuit, which receives an AC from a current source, and protects against current overflows, and minimize current source noises;

a voltage-enhancing rectification filtering circuit, which receive the AC from the current overflow protection and current source noise absorption circuit and convert the AC to DC after rectifying and filtering out the current;

a high-frequency oscillation circuit, which may receive the DC from the voltage-enhancing rectification filtering circuit and can convert the DC to rectangular wave signals; and a harmonic oscillation output circuit, which may receive the rectangular wave signals from the high-frequency oscillation circuit and convert these rectangular wave signals into sine wave (or near sine wave) signals so as to light up one or more fluorescent lights and may limit the current flow after one or more fluorescent light bulbs are lit.

2. The electronic stabilizer used for hand-held lamp as in claim 1, wherein the current overflow protection and current source noise absorption circuit includes a glass tube fuse, an inductor, a variable resistor and a capacitor, the fuse being used for the protection against current overflow, the inductor being able to eliminate the high frequency noises in the current source and the circuit, the variable resistor and the capacitor being able to eliminate the surges in voltage and noise.

3. The electronic stabilizer used for hand-held lamp as in claim 1, wherein the voltage-enhancing rectification filtering circuit comprises two diodes and two capacitors so as to rectify and filter the current received from the current overflow protection and current source noise absorption circuit so that the AC being converted into DC.

4. The electronic stabilizer used for hand-held lamp as in claim 3, wherein the voltage drop across the positive terminal of one conductor and the negative terminal of the other conductor is about 280 V (of DC).

5. The electronic stabilizer used for hand-held lamp as in claim 1, wherein the high-frequency oscillation circuit may covert the DC to high-frequency (about 38000 Hz) rectangular wave signals.

6. The electronic stabilizer used for hand-held lamp as in claim 1, wherein, in the high-frequency oscillation circuit, the DC being converted to rectangular wave signals by a transistor, a two-way diode and the positive feedback effect of a pulse transformer.

7. The electronic stabilizer used for hand-held lamp as in claim 1, wherein the harmonic oscillation output circuit comprises two transformers, the high voltage generated by the two transformers being able to light up two fluorescent light bulbs.

8. The electronic stabilizer used for hand-held lamp as in claim 1, wherein two or more switches are provided between the high-frequency oscillation circuit and the harmonic oscillation output circuit so as to turn on and off two or more lights.

* * * * *